US007930777B2

(12) United States Patent
Davis et al.

(10) Patent No.: US 7,930,777 B2
(45) **Date of Patent: *Apr. 26, 2011**

(54) BEDDING FOUNDATION HAVING NESTABLE STACKABLE COMPONENTS

(75) Inventors: Perry E. Davis, Joplin, MO (US); Franklin H. Rawlings, Diamond, MO (US); Darrell A. Richmond, Carthage, MO (US); Thomas W. Wells, Joplin, MO (US)

(73) Assignee: L&P Property Management Company, South Gate, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/875,701

(22) Filed: Sep. 3, 2010

(65) Prior Publication Data

US 2010/0325795 A1 Dec. 30, 2010

Related U.S. Application Data

(63) Continuation of application No. 12/352,208, filed on Jan. 12, 2009, now Pat. No. 7,805,780.

(51) Int. Cl.
*A47C 23/02* (2006.01)

(52) U.S. Cl. ..... 5/246; 5/260; 5/247; 5/255; 5/256; 5/248

(58) Field of Classification Search ..... 5/246–248, 5/255, 259.1, 260, 716, 719; 267/103, 106, 267/142; 11/247
See application file for complete search history.

(56) References Cited

U.S. PATENT DOCUMENTS 3,725,965 A * 4/1973 Smith et al. ..... 5/260
3,990,121 A * 11/1976 Whitaker ..... 5/260
4,055,337 A * 10/1977 Laiche et al. ..... 267/101
4,112,528 A * 9/1978 Higgins ..... 5/248
D251,642 S * 4/1979 Ramsey ..... D6/504
4,488,712 A * 12/1984 Higgins ..... 5/248
4,577,841 A * 3/1986 Hagemeister ..... 5/247
4,639,957 A * 2/1987 Wells et al. ..... 5/248
4,739,977 A * 4/1988 Dabney ..... 5/247
4,771,995 A * 9/1988 Wells et al. ..... 5/247
4,779,293 A * 10/1988 Dabney et al. ..... 5/247
4,853,991 A * 8/1989 Yates ..... 5/247
4,960,267 A * 10/1990 Scott ..... 5/248
4,995,125 A * 2/1991 Dennison ..... 5/247
5,052,064 A * 10/1991 Hagemeister et al. ..... 5/246
5,176,367 A * 1/1993 Rodgers et al. ..... 5/247
5,178,372 A * 1/1993 Rodgers et al. ..... 5/255
5,418,989 A * 5/1995 Roe ..... 5/719
5,652,986 A * 8/1997 Wells ..... 5/716
5,704,595 A * 1/1998 Kitchen et al. ..... 5/247
6,578,213 B2 * 6/2003 Dabney ..... 5/247
7,237,282 B2 * 7/2007 Beck et al. ..... 5/247
7,356,859 B2 * 4/2008 McCraw ..... 5/247
7,360,263 B2 * 4/2008 McCraw ..... 5/247
7,546,647 B1 * 6/2009 McCraw ..... 5/247

* cited by examiner

*Primary Examiner* — Robert G Santos
*Assistant Examiner* — Brittany M Wilson
(74) *Attorney, Agent, or Firm* — Wood, Herron & Evans, LLP

(57) ABSTRACT

A stackable wire core assembly for a bedding foundation which may be nestably stacked with numerous other such assemblies for transportation, thereby avoiding the need to compress and tie the assembly for shipping. The wire core assembly includes an upper wire grid, including a border wire and support wires extending between the ends of the border wire. Each support wire has resilient portions extending downwardly from the plane of the upper wire grid, each resilient portion having a flat bottom adapted to be secured to a wooden base frame and curved arms extending upwardly from opposed ends of the flat bottom.

18 Claims, 15 Drawing Sheets

BEDDING FOUNDATION HAVING NESTABLE STACKABLE COMPONENTS

CROSS REFERENCE TO RELATED APPLICATIONS

This application is a continuation of U.S. patent application Ser. No. 12/352,208 filed Jan. 12, 2009 which is fully incorporated herein.

FIELD OF THE INVENTION

This invention relates generally to bedding, and more particularly, to a formed wire bedding foundation.

BACKGROUND OF THE INVENTION

Bedding foundations or so-called box spring assemblies generally comprise a wooden base, an upper grid and a plurality of coil or bent wire spring modules extending between the wire grid and the wooden base. The coil or bent wire modules are welded or otherwise secured to an upper wire grid and stapled or otherwise secured to the base. As thus manufactured, these box spring assemblies are bulky. Shipping such assemblies to a manufacturer for application of padding and covering may be costly. In order to reduce shipping space requirements, it is customary to compress the box spring assemblies to reduce their individual thicknesses and, when compressed, to tie them in their compressed state. This involves providing presses and ties which are expensive, and the extra operations of pressing and tying the assemblies. At the delivery end, the manufacturer must cut and discard the ties before applying the covering. These additional material and handling costs increase the end cost of box spring assemblies.

In U.S. Pat. No. 5,052,064, there is disclosed a nestably stackable bedding foundation assembly which overcomes the manufacturing and shipping problems characteristic of the more traditional coil or modular box springs or bedding foundations. The bedding foundation assembly of U.S. Pat. No. 5,052,064 comprises a rectangular border wire and transversely spaced, parallel and longitudinally extending support wires parallel to the border wire sides and having ends connected to the border wire ends. These support wires are generally corrugatedly formed along their lengths, having peaks and valleys with the peaks being generally co-planar with the plane defined by the border wire and the valleys being displaced beneath and intermediate of the peaks. Longitudinally spaced, parallel and transversely extending upper connector wires, parallel to the border wire ends, are connected along their lengths to the peaks of the support wires. The valleys of the support wires are stapled to the wooden base upon assembly. The longitudinal voids between the peaks of the support wires are of a greater dimension than the valleys of the support wires. This configuration enables one nestably stackable bedding foundation assembly to be nestably stacked atop a second assembly since the support wire valleys of the first assembly may enter into the voids between the peaks of the support wires of the second assembly. Such a nestably stacked arrangement results in a total height dimension which is less than the sum of the individual assembly height dimensions.

One advantage of the bedding foundation assembly of U.S. Pat. No. 5,052,064 is that it enables relatively inexpensive bedding foundation wire cores to be tightly compacted and shipped in a minimum of space to an assembly destination, thereby reducing the ultimate cost of the bedding foundation to the assembler and ultimately to the customer. The bedding foundation of U.S. Pat. No. 5,052,064 also may be rapidly loaded by a manufacturer for transportation to the destination of assembly without the need for compressing and tying box spring assemblies. However, once assembled, the bedding foundation of U.S. Pat. No. 5,052,064 has little resiliency or spring back.

In certain applications, one may desire a box spring or bedding foundation having greater spring back or resiliency than the bedding foundation disclosed in U.S. Pat. No. 5,052,064.

SUMMARY OF THE INVENTION

The present invention is directed to a bedding foundation or box spring comprising nestably stackable components which has advantages of the bedding foundation disclosed in U.S. Pat. No. 5,052,064, which is fully incorporated by reference herein, but which has greater resiliency than the assembled bedding foundation of U.S. Pat. No. 5,052,064. In the present invention, as in the bedding foundation disclosed in U.S. Pat. No. 5,052,064, the foundation comprises a rectangular border wire and lengthwise or transversely extending parallel support wires connected at opposite ends to opposite ends or opposite sides of the border wire. As in the '064 patent, these support wires have flattened peaks and flattened valleys with the peaks being generally co-planar and in the plane of the border wire and the valleys being displaced beneath and intermediate of the peaks. As in the '064 patent, there are multiple, parallel connector wires extending perpendicular to the general direction of the support wires, the connector wires being generally in the plane of the border wire. These connector wires are fixedly attached at their opposite ends to the border wire sides and are attached intermediate of their ends to the peaks of the support wires. But unlike the support wires of the '064 patent, the support wires of foundation of the present invention have some resiliency or give due to their configuration. Thereby, the resulting foundation has additional compressive strength and/or resiliency not characteristic of prior art wire core bedding foundations.

The bedding foundation comprises a rectangular base and a nestably stackable wire core assembly fixedly attached atop the base. The nestably stackable assembly comprises a rectangular border wire having two parallel sides and two parallel ends. The nestably stackable assembly further comprises transversely spaced and longitudinally extending support wires having ends connected to the border wire ends. At least some of the support wires have flattened peaks and flattened valleys and non-linear arms connecting at least some of the flattened peaks and flattened valleys. The flattened peaks are generally co-planar with a plane defined by the border wire, the flattened valleys being vertically displaced beneath and intermediate of the flattened peaks. The nestably stackable assembly further comprises longitudinally spaced, parallel and transversely extending upper connector wires parallel to the border wire ends and having ends connected to the border wire sides, the upper connector wires being connected intermediate of their ends along their lengths to the flattened peaks of the support wires. In addition, the foundation may include padding overlying the nestably stackable assembly and a fabric covering encasing the padding, the nestably stackable assembly, and the base.

In multiple embodiments, the arms of the support wires which extend upwardly from the flattened valleys are arcuate and generally helically shaped. Two curved arms and a flattened valley comprise a pocket. The support wires may be changed depending upon the desired characteristics of the assembled foundation. In some embodiments, each of the support wires may be identically configured. In some embodiments, one or more of the support wires may have pockets configured differently in order to posturize a product, i.e., impart different firmnesses to different areas or regions of the product. In some embodiments, support wires like those disclosed in the '064 patent may be incorporated into the nestable stackable wire core assemblies. In any of the disclosed embodiments, support wires like those disclosed in the '064 patent lacking pockets or curved arms may be used for edge support.

One advantage of the present bedding foundation is that each foundation has increased compressed load strength when compared to prior art bedding foundations incorporating nestable stackable wire core assemblies. This increased compressed load strength is accomplished by transferring compressive forces on the wire core from the wire core assembly to the underlying slats of the foundation base.

These and other advantages of the present invention will more readily become apparent from the description of the drawings herein, in which:

DETAILED DESCRIPTION OF THE DRAWINGS

Figure 1:
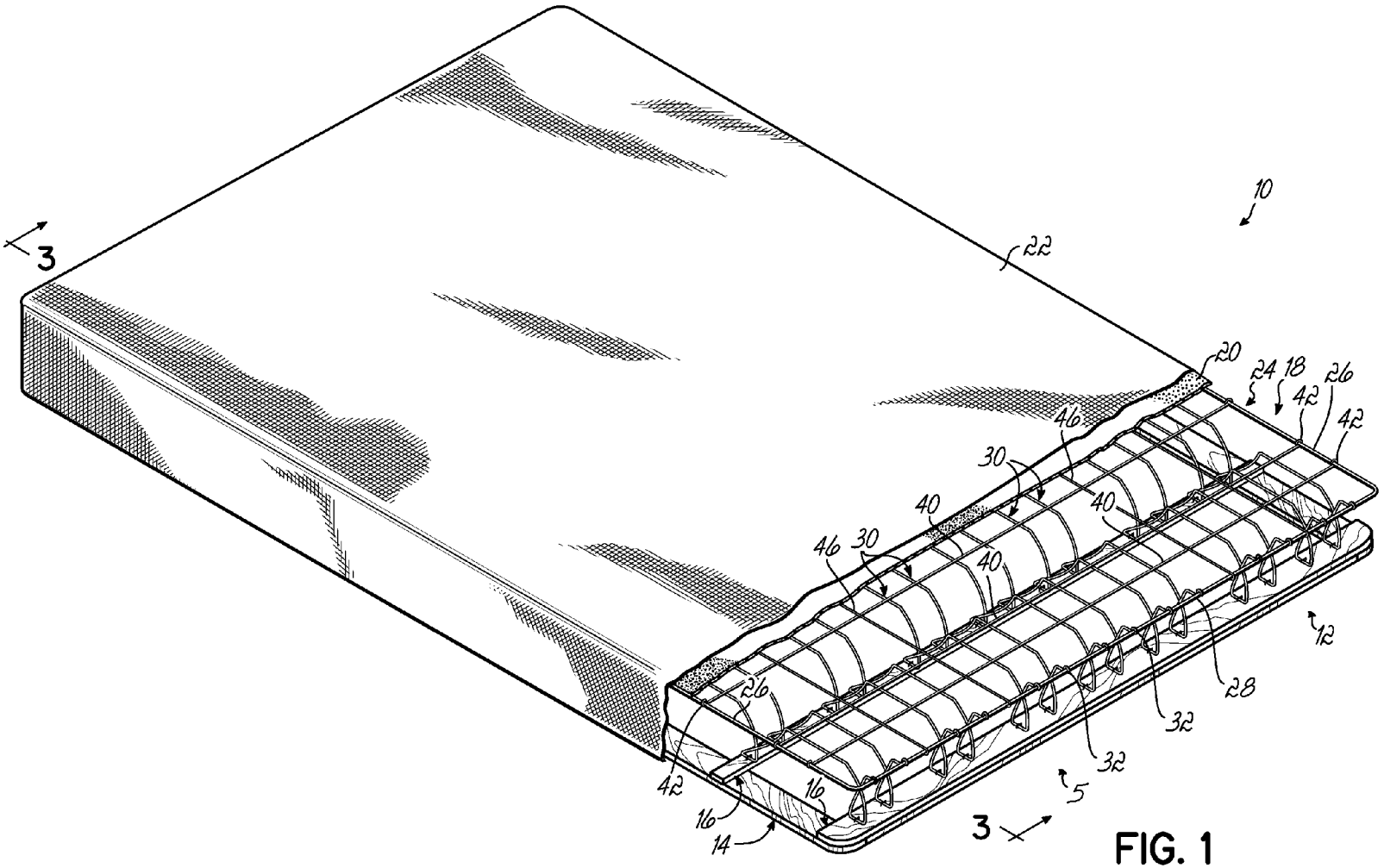
FIG. 1 is a perspective view, partially broken away, of a bedding foundation embodying one embodiment of the invention.

Referring to FIG. 1, an assembled bedding foundation 10 is illustrated. The foundation 10 has a rectangular wooden base 12, including a rectangular frame 14 on which are attached transverse wooden slats 16. Atop these transverse slats 16 is the nestably stackable assembly or wire core 18. Padding 20, which may be foam, fiber or any like material, overlies the nestably stackable assembly 18, and a fabric covering 22 surrounds the nestably stackable assembly 18, the padding 20 and the base 12.

The nestably stackable assembly 18 comprises a rectangular steel border wire 24 having two parallel sides 26, 26 and two parallel ends 28 (only one being shown in FIG. 1 and FIG. 2) with the parallel sides 26, 26 being longer than the parallel ends 28, 28.

Figure 3:
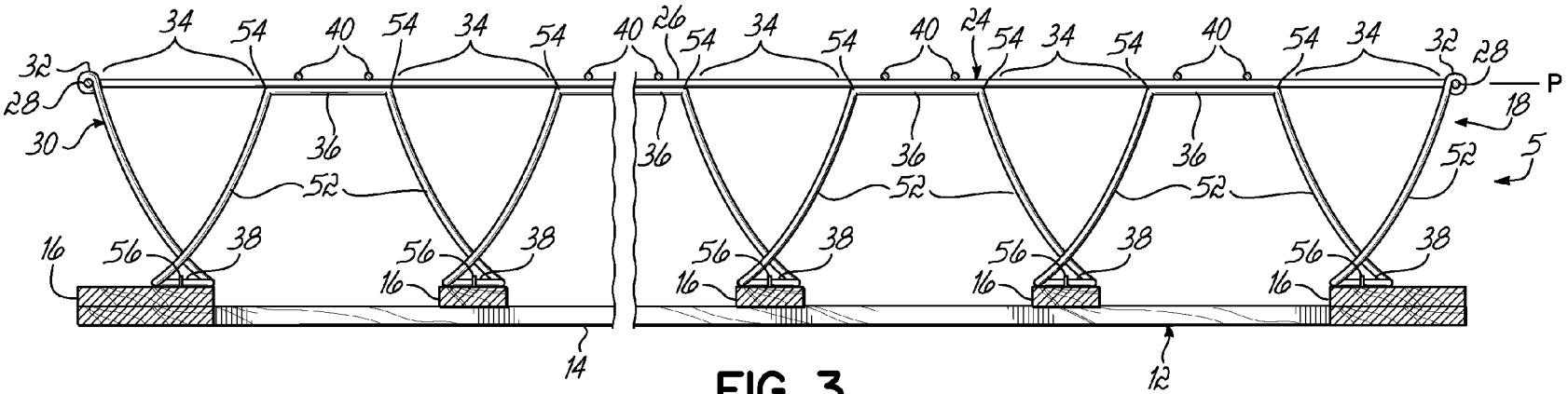
FIG. 3 is a view taken along line 3-3 of FIG. 1, but with the covering materials removed for purposes of illustrating the support wires.

Transversely spaced and longitudinally extending resilient support wires 30 extend from end-to-end of the nestably stackable assembly 18 and have ends 32 (see FIG. 3) which are crimped or wrapped around and/or welded to the ends 28, 28 of the border wire 24. As seen in FIG. 3, each resilient support wire 30 is formed so as to have spaced resilient pockets 34 along its length which provide the support wire 30 with spring back or resiliency or give when loaded. The degree or amount of spring back or resiliency of the support wire 30 may vary depending upon the configuration of the pockets 34 of the support wires 30 and the characteristics of the wire used to make the support wire 30 such as the gauge or tensile strength of the wire, for example. The support wire 30 has a plurality of spaced flattened peaks 36 and flattened valleys 38 (see FIG. 3). These flattened peaks 36 are generally co-planar with the plane P defined by the border wire 24 (see FIG. 3), with the flattened valleys 38 being vertically spaced beneath and intermediate of the flattened peaks 36. The length of each flattened peak is preferably identical and defined between locations 54, as shown in FIG. 3.

Longitudinally spaced, parallel and transversely extending steel upper connector wires 40 extend parallel to the border wire ends 28, 28 and have ends 42 which are crimped around and/or welded to the border wire sides 26, 26. These upper connector wires 40 are welded intermediate of their ends 42 along their lengths at locations 44 to the flattened peaks 36 of the support wires 30. Although the drawings of the nestably stackable assembly 18 of the embodiment of FIGS. 1-5 show two spaced upper connector wires 40 welded to each flattened peak 36 of each support wire 30, any number of such upper connector wires may be connected or welded to each flattened peak 36 of each support wire 30.

Similarly, transversely spaced, parallel and longitudinally extending upper supplemental wires 46 extend parallel to the border wire sides 26, 26 and have ends 48 which are crimped around and/or welded to the border wire ends 28, 28. These upper supplemental wires 46 are welded intermediate of their ends 48 along their lengths at locations 50 (see FIG. 2) to the upper connector wires 40. Although the drawings of the nestably stackable assembly 18 of the embodiment of FIGS. 1-5 shows four spaced upper supplemental wires 46 in the nestable stackable wire core 18, any number of such wires may be used.

In the embodiment of foundation shown in FIGS. 1-5, the pocket 34 of each support wire 30 comprises a flattened valley 38 which is parallel the border wire sides 26, 26 and is secured to the slats 16 of the base 12 with at least one staple. Any number of staples or any other fastener may be used to secure the flattened valleys 38 of the support wires 30 to the base 12 in any embodiment described herein. See FIG. 3.

Figure 2:
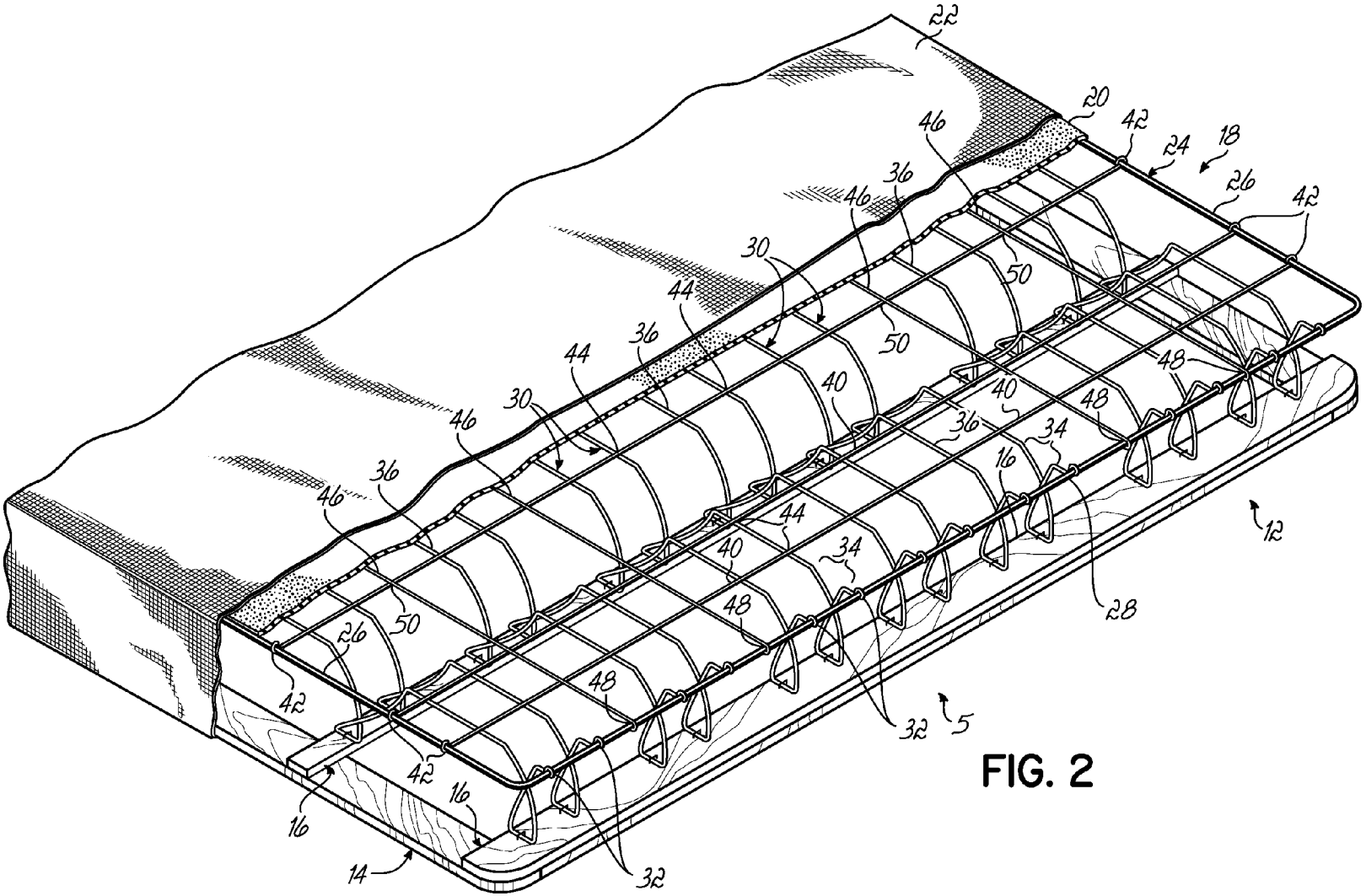
FIG. 2 is an enlarged perspective view of a portion of the bedding foundation of FIG. 1.

The pocket 34 of the support wire 30 further comprises a pair of curved or arcuate arms 52 which extend upwardly from opposed ends of the flattened valley 38 of the support wire 30. Each of arms 52 is shaped in a helical formation, such as the diameter of the pocket 34 increases as the pocket extends upwardly, as shown in FIG. 3. As shown in FIG. 1, if the front 5 of the foundation 10 is to the right of FIG. 3, then one of the arms 52 extends upwardly and rearwardly from the front end of a flattened valley 38 of the support wire 30 and the other arm 52 of the pocket 34 extends upwardly and forwardly from the rear end of the same flattened valley 38 of the support wire 30. This is best shown in FIGS. 2 and 3. As shown in FIG. 3, a pocket 34 is defined as being between the ends of adjacent flattened peaks 36 of a support wire 30, between locations 54 of the support wire 30.

The nestably stackable wire core assembly 18 of the bedding foundation 10 is generally manufactured by a supplier, who stacks a plurality of like assemblies, then ships such stack to an assembler. The assembler lifts one of the wire core assemblies from the stack and staples or secures it to wooden base 12. He/she then adds the padding 20 and upholstery 22 to make a completed product or foundation 10.

Figure 4:
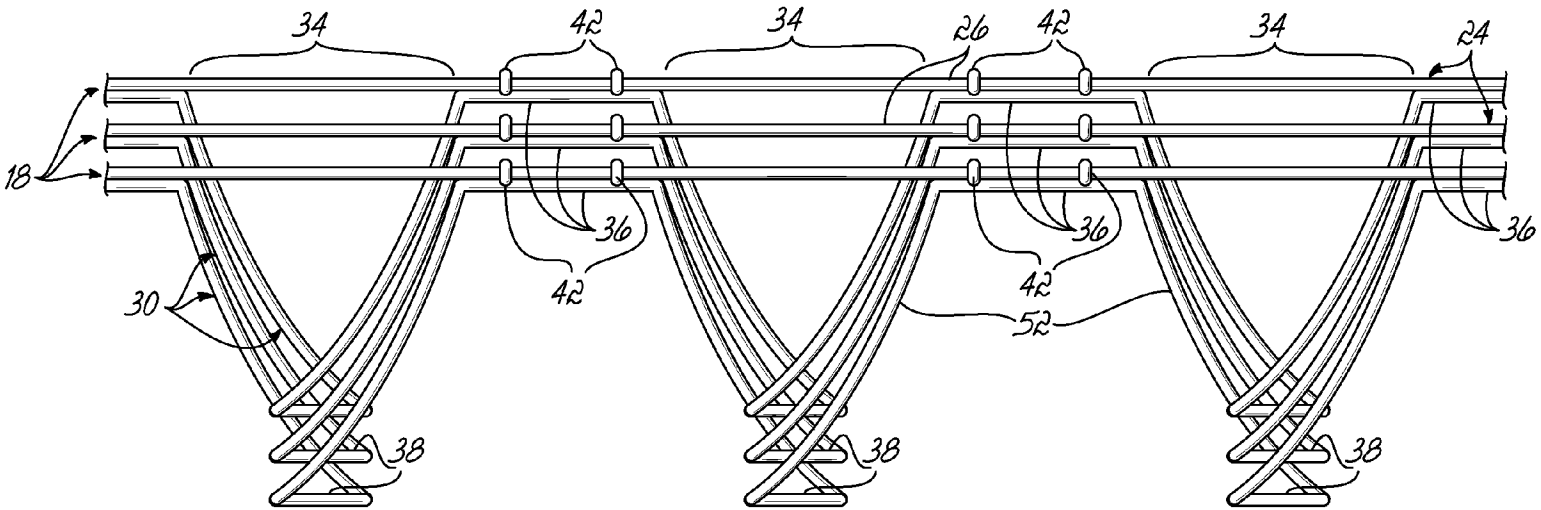
FIG. 4 is a partial side elevational view, broken away, of multiple wire core assemblies of the foundation of FIG. 1 stacked and nested one within the other for shipment.
Figure 5:
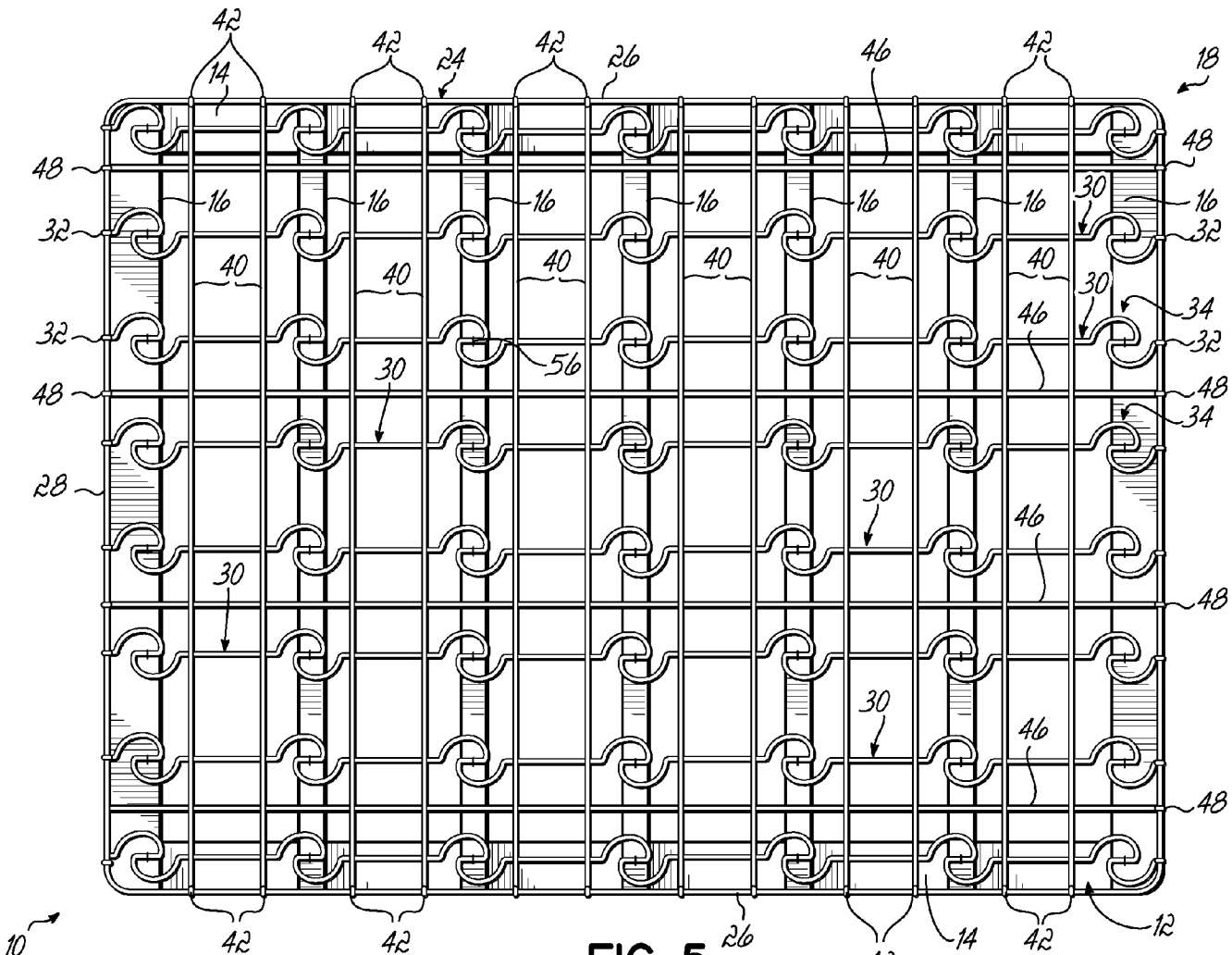
FIG. 5 is a top view of the foundation of FIG. 1 without the padding and covering.
Figure 6:
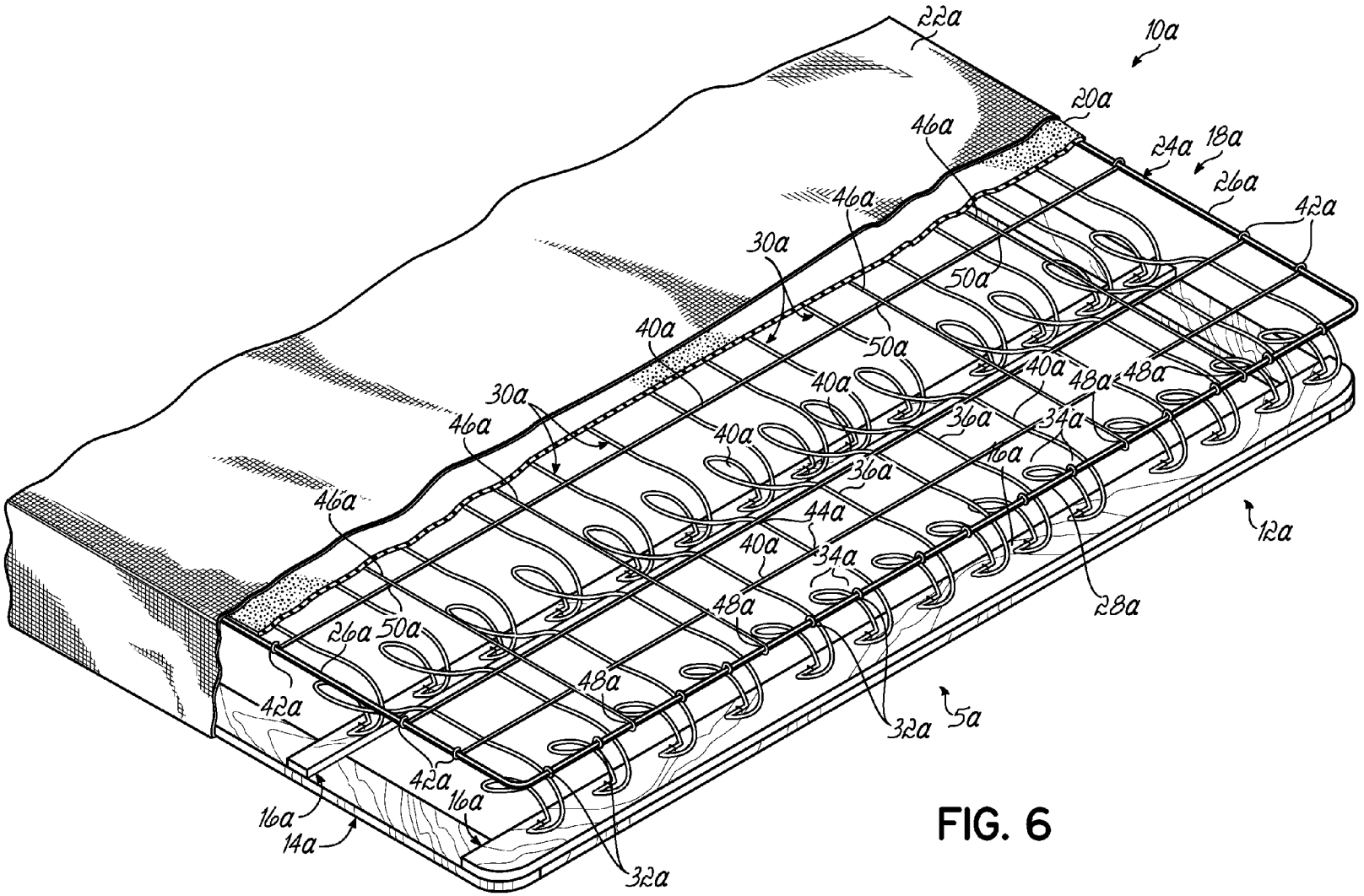
FIG. 6 is an enlarged perspective view of a portion of an alternative embodiment of bedding foundation.

The present invention facilitates shipment of the wire core assemblies 18 by a supplier to an assembler. With reference to FIG. 4, it will be seen that a first stackable assembly or core 18 may be placed upon a surface with the valleys 38 of the support wires 30 oriented downwardly and the flattened peaks 36 of the support wires 30 oriented upwardly. Next, a second like assembly 18 may be placed atop the first assembly 18, with its support wire valleys 38 and flattened support wire peaks 36 likewise oriented downwardly and upwardly, respectively. The flattened valleys 38 of the second assembly 18 are thereby allowed to enter into the voids or pockets 34 between the flattened peaks 36 of the support wires 30 of the first assembly 18. The second assembly 18 nestles downwardly within the first assembly 18 until the outside dimension of the flattened valleys 38 of the second assembly 18 is equal to the inside dimension of the flattened valleys 38 of the first assembly 18. At this point, the second assembly 18 comes to rest within the first assembly 18, with the overall height of the nested assemblies being substantially less than the sum of the individual heights of the assemblies. Although FIG. 3 shows a stack of three wire core assemblies 18, any number of wire core assemblies may be nested and stacked together for storage or shipment.

In order to assemble foundation 10, the base 12 is secured with staples 56 (only a few being shown) to one of the nestably stackable wire core assemblies 18. More particularly, the flattened valleys 38 of the pockets 34 of the nestably stackable wire core assembly 18 are stapled to the slats 16 of the base 12.

Figure 7:
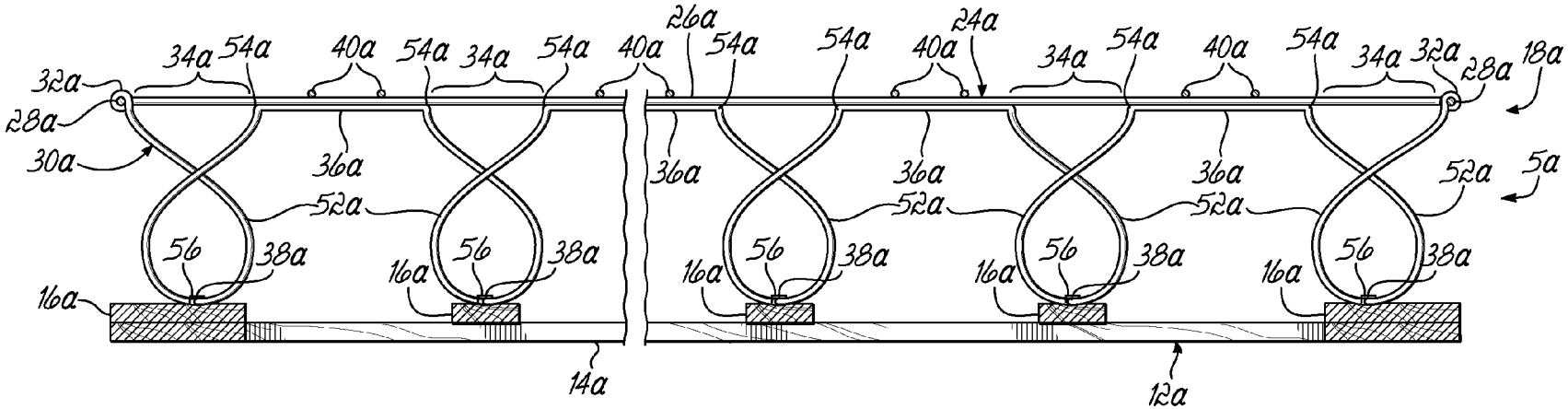
FIG. 7 is a view similar to FIG. 3, but of the embodiment of foundation shown in FIG. 6.
Figure 8:
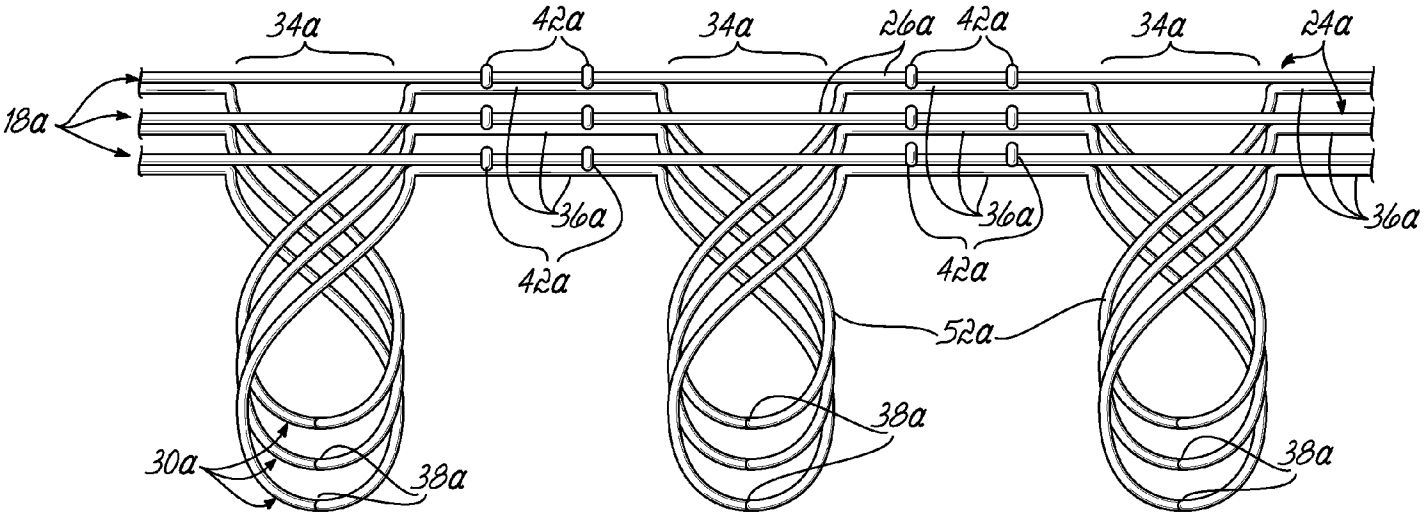
FIG. 8 is a view similar to FIG. 4, but of the embodiment of foundation shown in FIG. 6.
Figure 9:
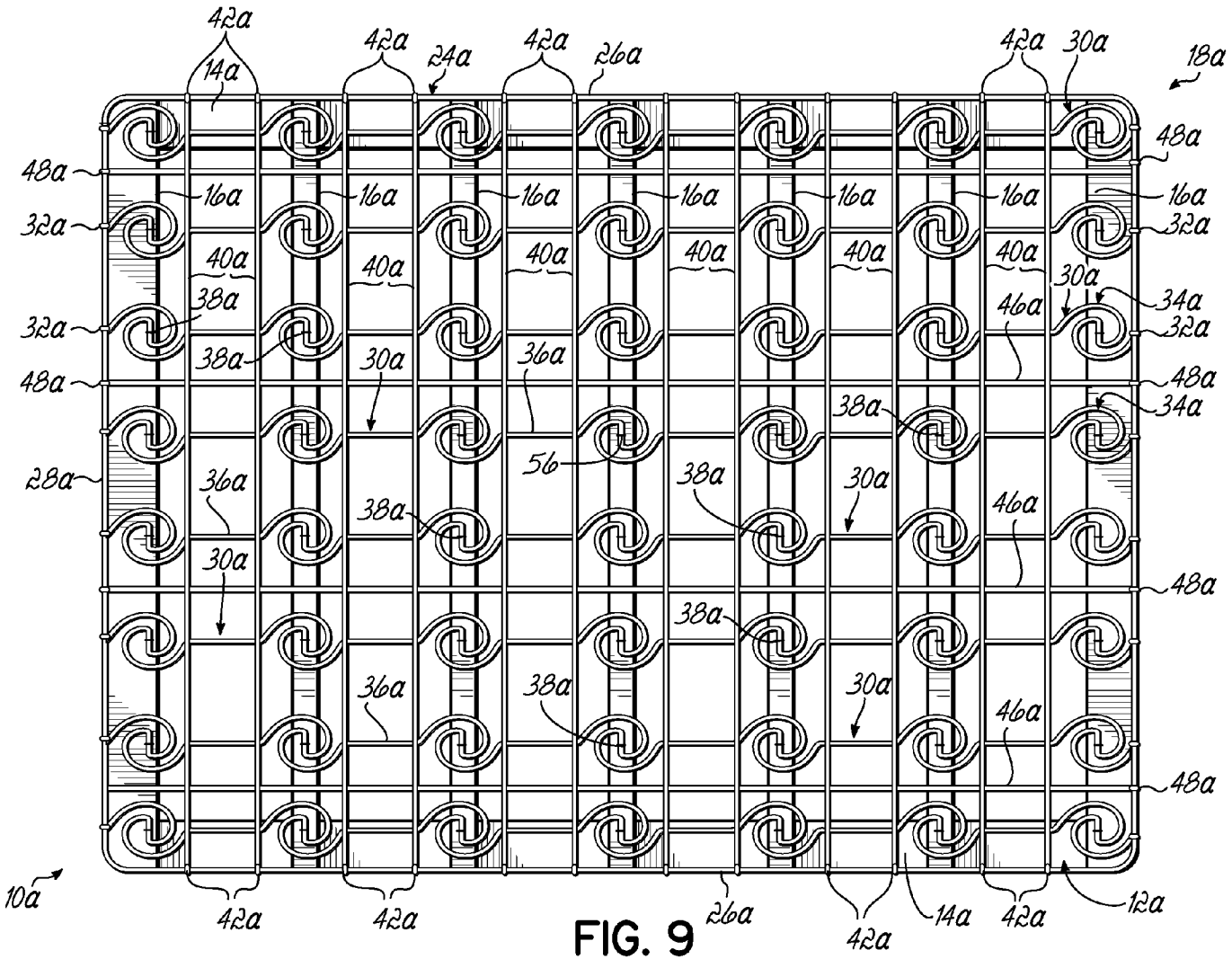
FIG. 9 is a top view of the foundation of FIG. 6 without the padding and covering.
Figure 10:
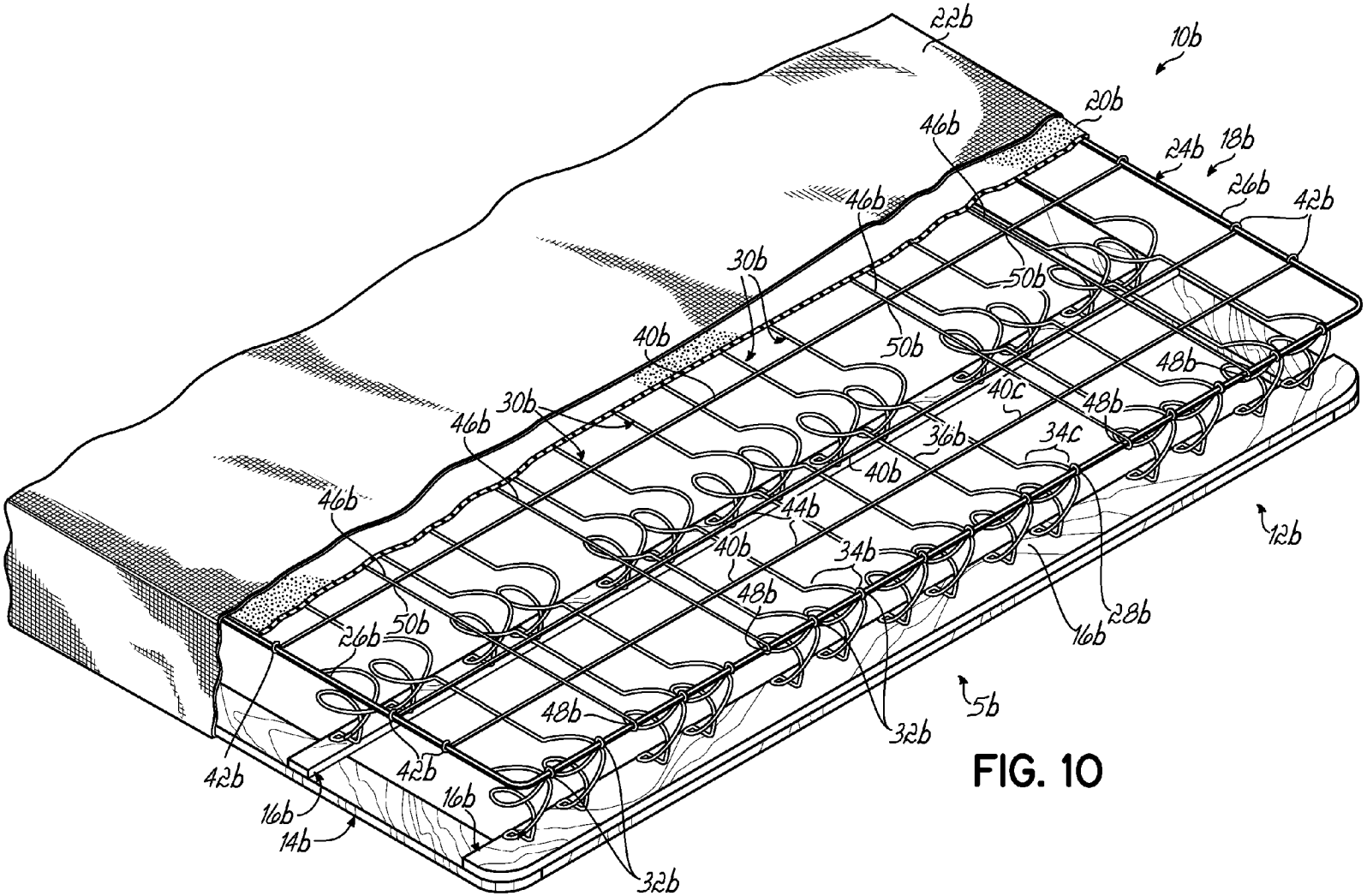
FIG. 10 is an enlarged perspective view of a portion of an alternative embodiment of bedding foundation.

An alternative embodiment of foundation 10*a* is shown in FIGS. 6-9. For simplicity, like numbers have been used for like parts but have an "a" designation after the number. The components of the nestably stackable wire core assembly 18*a* are identical to those of the wire core assembly 18 described above with the exception of the support wires. The support wires 30*a* of this embodiment, like the embodiment described above with reference to FIGS. 1-5, have flattened peaks 36*a* and pockets 34*a* between the flattened peaks 36*a*. As best shown in FIG. 9, each pocket 34*a* of support wire 30*a* has a flattened valley 38*a* which is parallel the ends 28*a*, 28*a* of the border wire 24*a*, a different orientation than the valleys 38 of the support wires 30 of the embodiment of FIGS. 1-5. As shown in FIG. 7, a pocket 34*a* is defined as being between the ends of adjacent flattened peaks 36*a* of a support wire 30*a*, between the locations 54*a* of the support wire 30*a*.

In order to assemble foundation 10*a*, the base 12*a* is secured with staples 56*a* (only a few being shown) to one of the nestably stackable wire core assemblies 18*a*. More particularly, the flattened valleys 38*a* of the pockets 34*a* of the nestably stackable wire core assembly 18*a* are stapled to the slats 16*a* of the base 12*a*.

Figure 11:
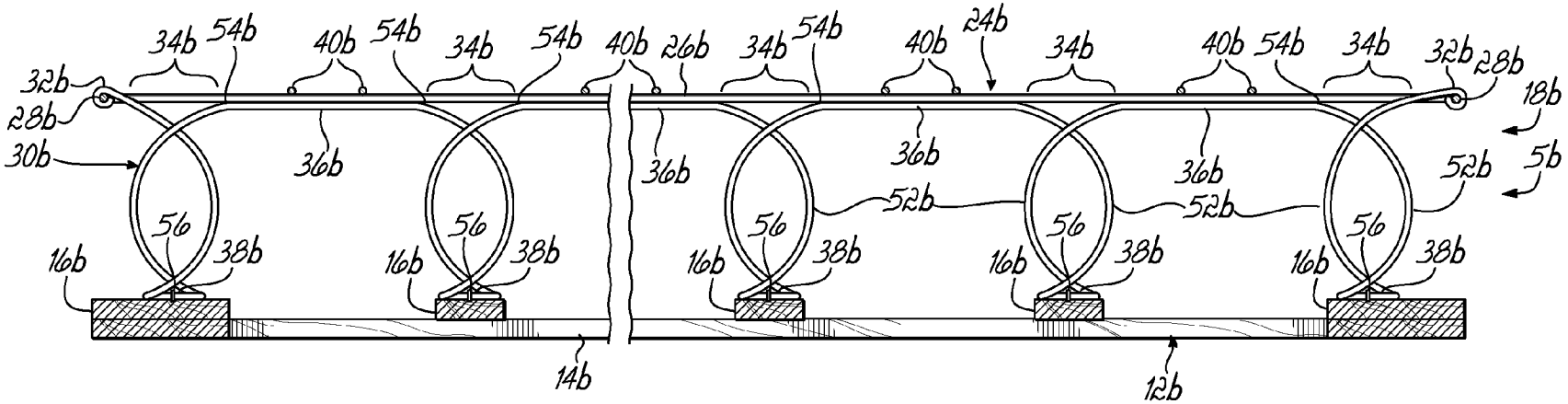
FIG. 11 is a view similar to FIG. 3, but of the embodiment of foundation shown in FIG. 10.
Figure 12:
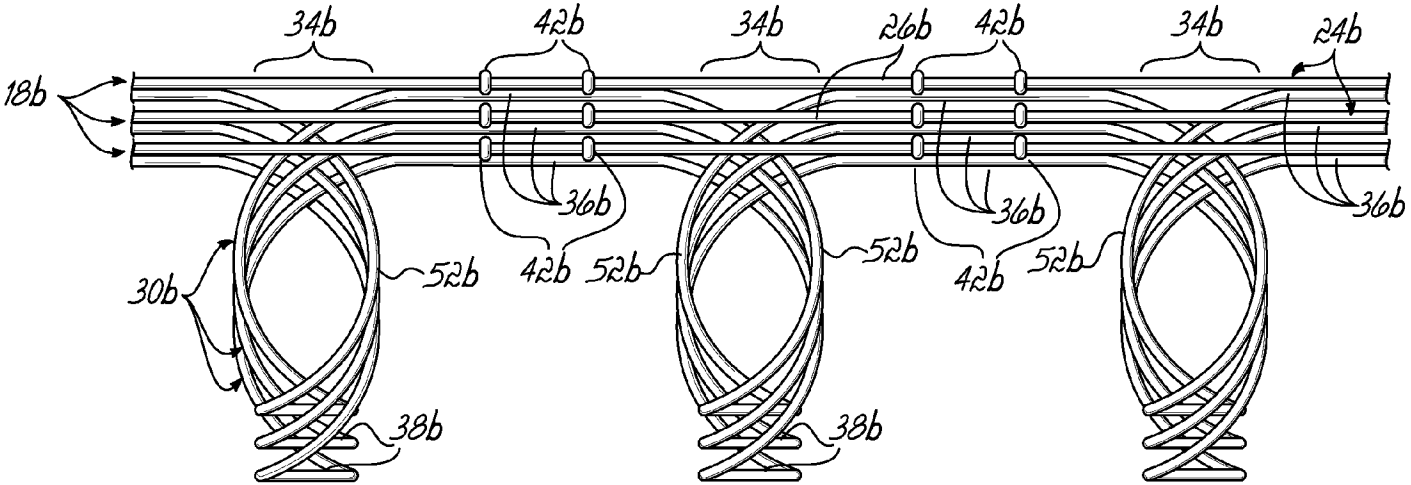
FIG. 12 is a view similar to FIG. 4, but of the embodiment of foundation shown in FIG. 10.
Figure 13:
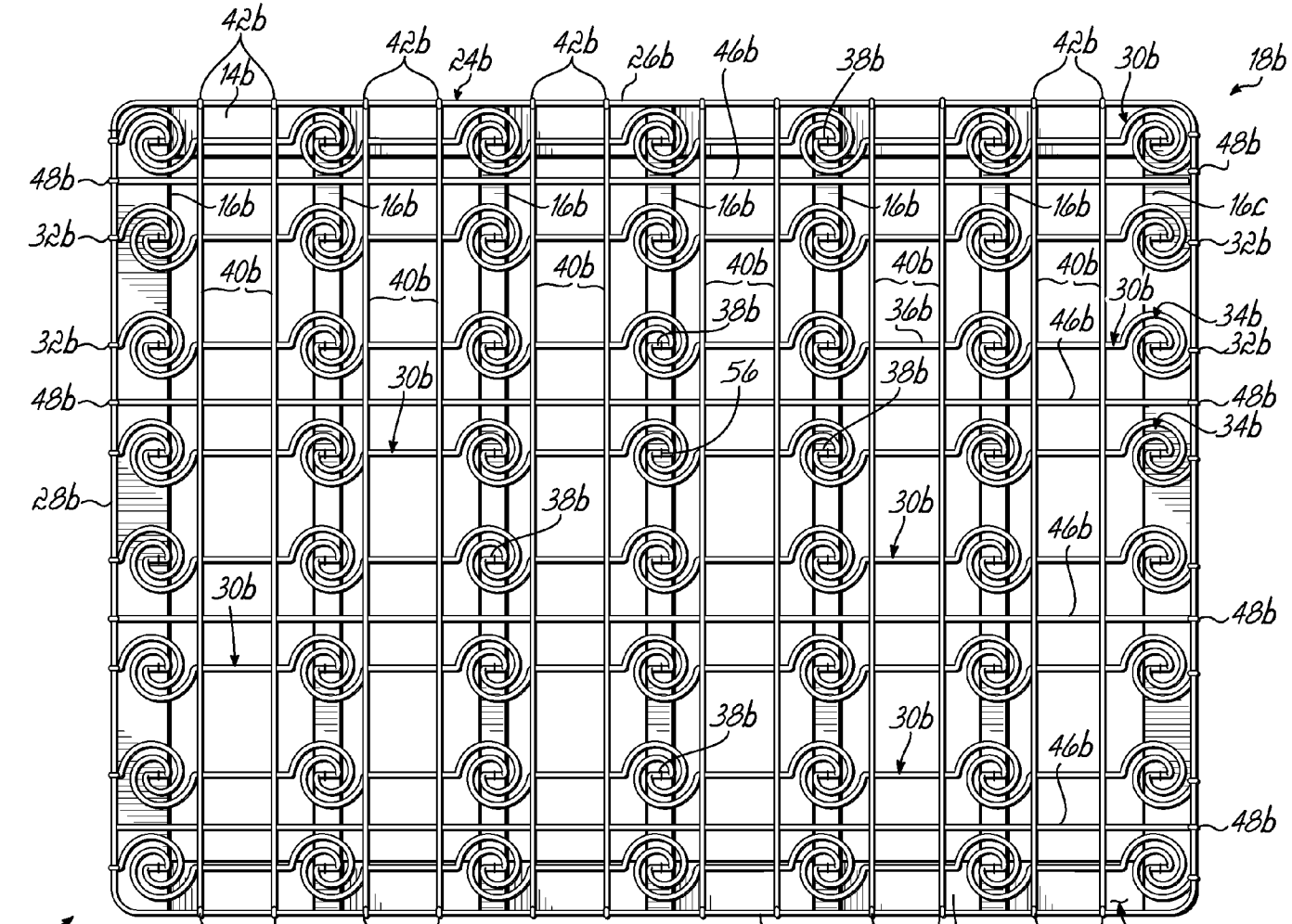
FIG. 13 is a top view of the foundation of FIG. 10 without the padding and covering.

An alternative embodiment of foundation 10*b* is shown in FIGS. 10-13. For simplicity, like numbers have been used for like parts but have a "b" designation after the number. The components of the nestably stackable wire core assembly 18*b* are identical to those of the wire core assembly 18 described above with the exception of the support wires. The support wires 30*b* of this embodiment, like the embodiments described above with reference to FIGS. 1-9, have flattened peaks 36*b* and pockets 34*b* between the flattened peaks 36*b*. As best shown in FIG. 13, each pocket 34*b* of support wire 30*b* has a flattened valley 38*b* which is parallel the ends 28*b*, 28*b* of the border wire 24*b*, a different orientation than the valleys 38 of the support wires 30 of the embodiment of FIGS. 1-5. As shown in FIG. 11, a pocket 34*b* is defined as being between the ends of adjacent flattened peaks 36*b* of a support wire 30*b*, between the locations 54*b* of the support wire 30*b*.

In order to assemble foundation 10*b*, the base 12*b* is secured with staples 56 to one of the nestably stackable wire core assemblies 18*b*. More particularly, the flattened valleys 38*b* of the pockets 34*b* of the nestably stackable wire core assembly 18*b* are stapled to the slats 16*b* of the base 12*b*.

Figure 14:
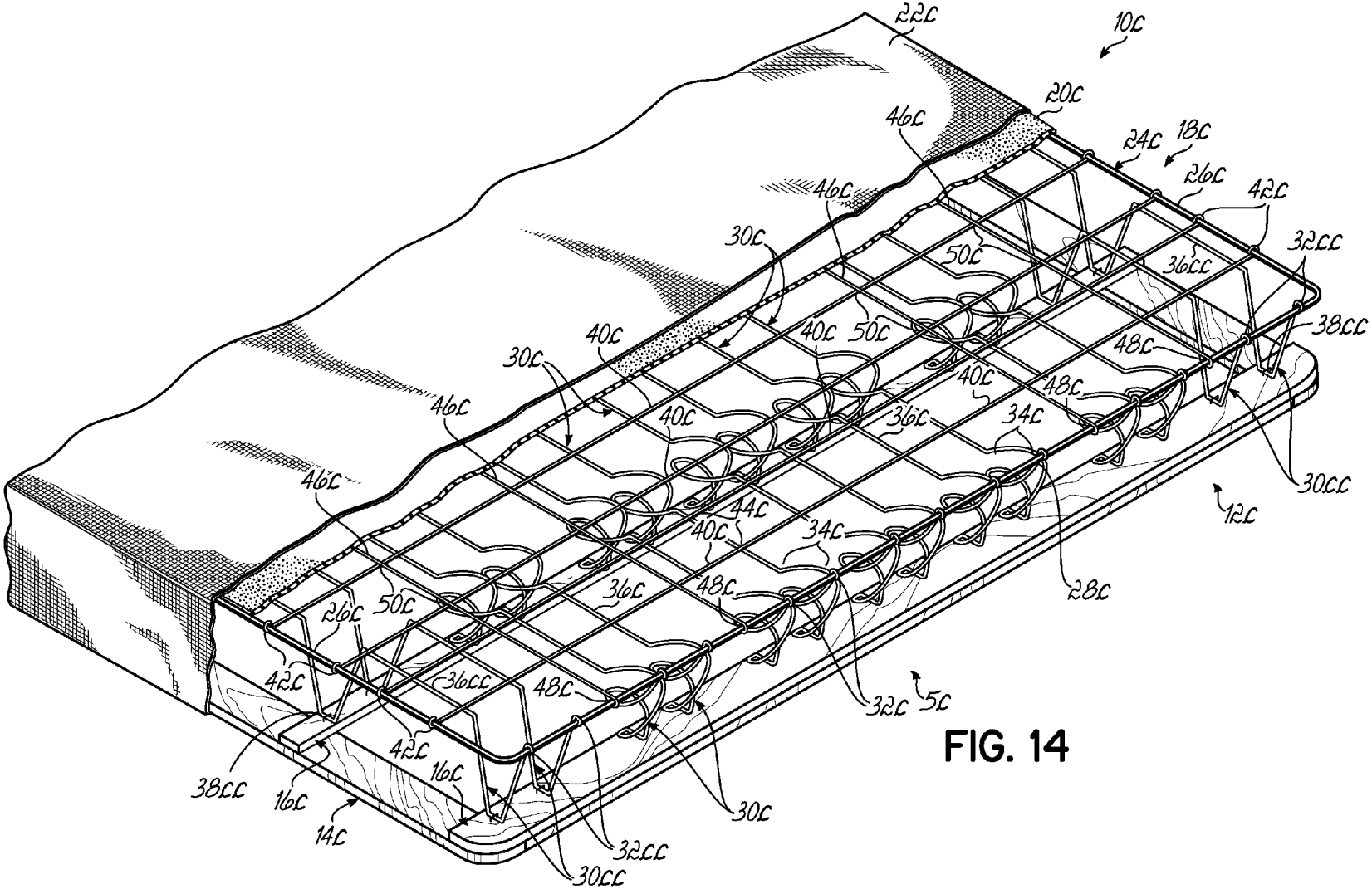
FIG. 14 is an enlarged perspective view of a portion of an alternative embodiment of bedding foundation.
Figure 15:
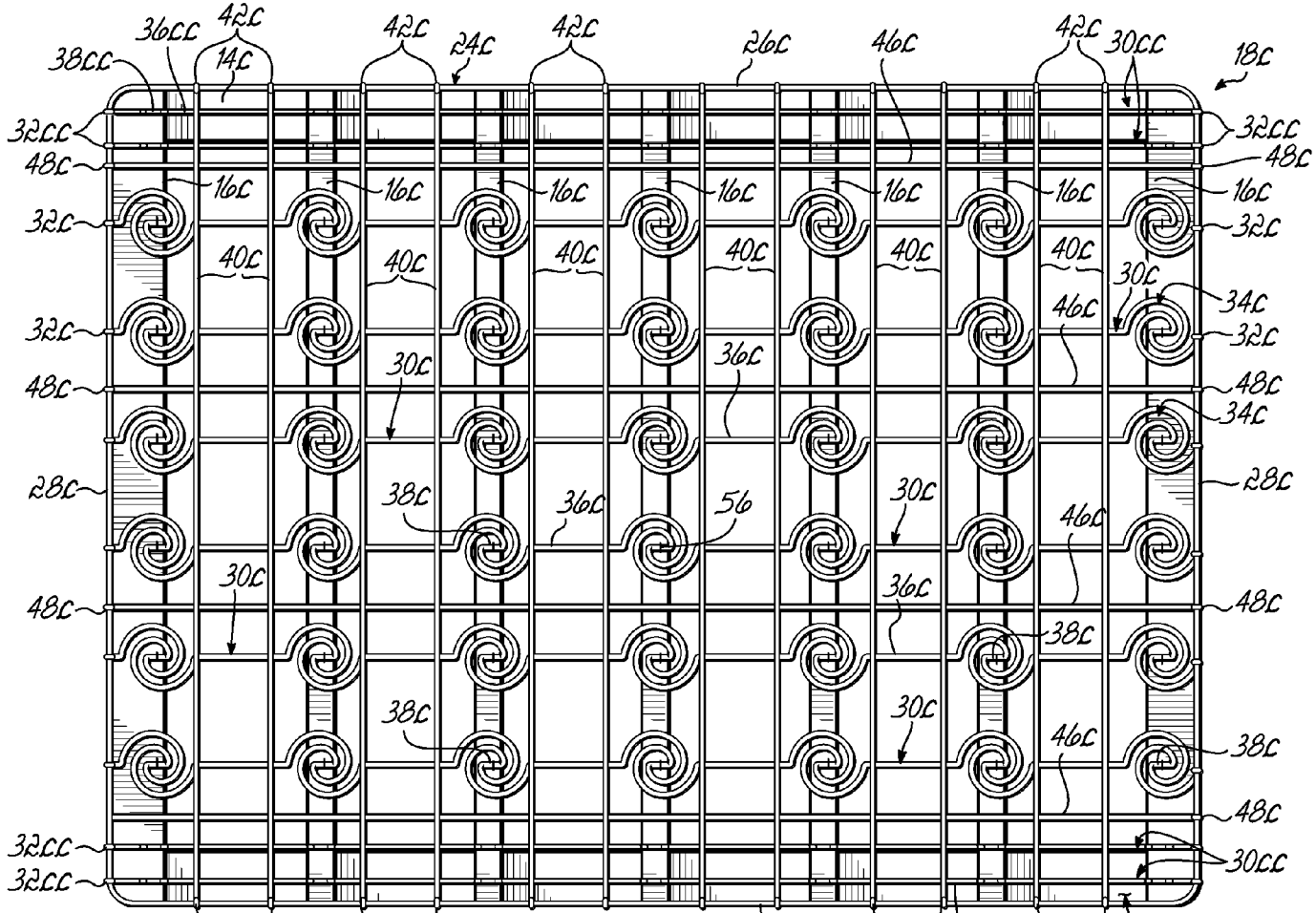
FIG. 15 is a top view of the foundation of FIG. 14 without the padding and covering.

An alternative embodiment of foundation 10*c* is shown in FIGS. 14-15. This bedding foundation 10*c* has increased edge support when compared to the other embodiments described above. The foundation 10*c* comprises a base 12*c* secured to a nestably stackable wire core assembly 18*c* with staples 56. For simplicity, like numbers have been used for like parts, but have a "c" designation after the number. The components of the nestably stackable wire core assembly 18*c* are identical to those of the wire core assembly 18 described above with the exception of the support wires.

This embodiment of foundation 10*c* has a nestably stackable wire core assembly 18*c* using two different configurations of support wires: internal support wires 30*c* and edge support wires 30*cc*. These edge support wires 10*cc* lack resiliency and are identical to the support wires shown in U.S. Pat. No. 5,052,064.

The internal support wires 30*c* are illustrated as being the same as the support wires 30*b* of the embodiment described above and shown in FIGS. 10-13. These internal support wires 30*c* have flattened peaks 36*c* and pockets 34*c* between the flattened peaks 36*c*. However, edge support wires as described and shown in U.S. Pat. No. 5,052,064 may be incorporated into any of the foundations described, illustrated or contemplated herein. Any of the nestably stackable wire core assemblies illustrated and/or described herein may be modified to include edge support wires like those shown in FIGS. 14 and 15 to provide edge support.

As best shown in FIGS. 14 and 15, each side of the nestably stackable wire core assembly 18*c* has a pair of edge support wires 30*cc*. Each edge support wire 18*cc* has flattened valleys 38*cc* and flattened peaks 36*cc* and is secured at its ends 32*cc* to the ends 28*c* (only one being shown in FIG. 14) of the border wire 24*c*. Each edge support wire 10*cc* is identical to the support wire shown and described in U.S. Pat. No. 5,052,064. Although the embodiment shown in FIGS. 14 and 15 has a total of four edge support wires 10*cc*, two per side, any number of edge support wires may be used in any of the foundations described or illustrated in this document to provide increased edge support.

In order to assemble foundation 10*c*, the base 12*c* is secured with staples 56 to one of the nestably stackable wire core assemblies 18*c*. More particularly, the flattened valleys 38*c* of the pockets 34*c* of the support wires 30*c* of the nestably stackable wire core assembly 18*c* are stapled to the slats 16*c* of the base 12*c* along with the flattened valleys of the edge support wires 10*cc*.

Figure 16:
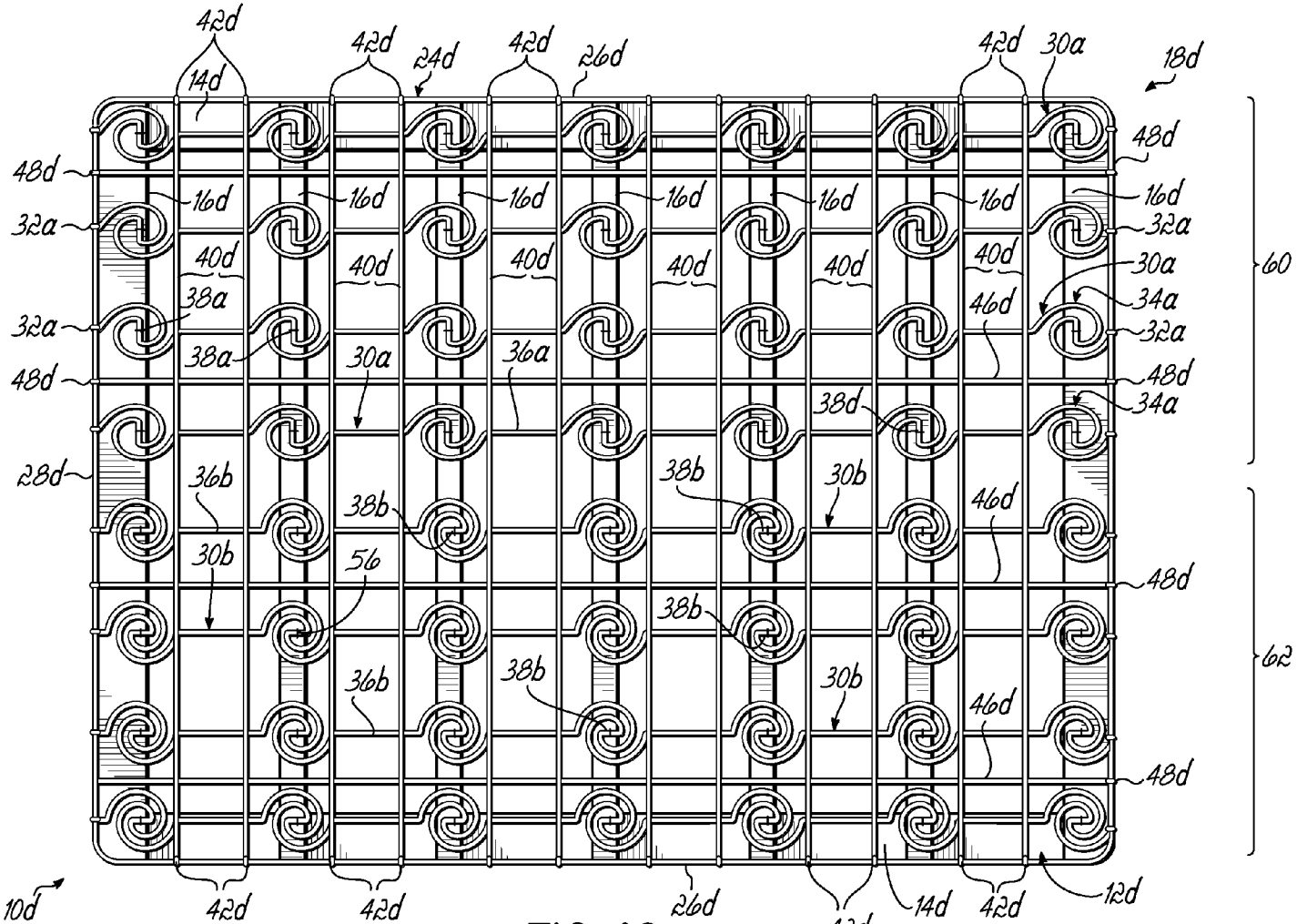
FIG. 16 is a top view of a portion of an alternative embodiment of bedding foundation.

An alternative embodiment of foundation 10*d* is shown in FIG. 16. The foundation 10*d* comprises a base 12*d* secured to a nestably stackable wire core assembly 18*d* with staples 56. For simplicity, like numbers have been used for like parts, but have a "d" designation after the number. The components of the nestably stackable wire core assembly 18*d* are identical to those of the wire core assembly 18 described above with the exception of the support wires.

This foundation 10*d* is posturized into two sections of different firmness: a "firm" section 60 and a "soft" section 62, each section having different support wires. The support wires of the "firm" section 60 are those support wires 30*a* of the embodiment illustrated in FIGS. 6-9. The support wires of the "soft" section 62 are those support wires 30*b* of the embodiment illustrated in FIGS. 10-13. Although each section 60, 62 is illustrated in FIG. 16 as having four support wires, depending upon the size of the foundation, each section 60, 62 may have any desired number of support wires. Although FIG. 16 shows support wires 30*a* being in the "firm" section 60 and support wires 30*b* being in the "soft" section 62, the "firm" section 60 may comprise support wires 30 and the "soft" section 62 comprise support wires 32*a* or 32*b*. Similarly, each section may have any desired support wires to impart a desired degree of firmness to the section. This foundation 10*d* may be called in the bedding industry a "his" and "hers" foundation.

In order to assemble foundation 10*d*, the base 12*d* is secured with staples 56 to one of the nestably stackable wire core assemblies 18*d*. More particularly, the flattened valleys 38*d* of the pockets 34*d* of the nestably stackable wire core assembly 18*d* are stapled to the slats 16*d* of the base 12*d*.

Figure 17:
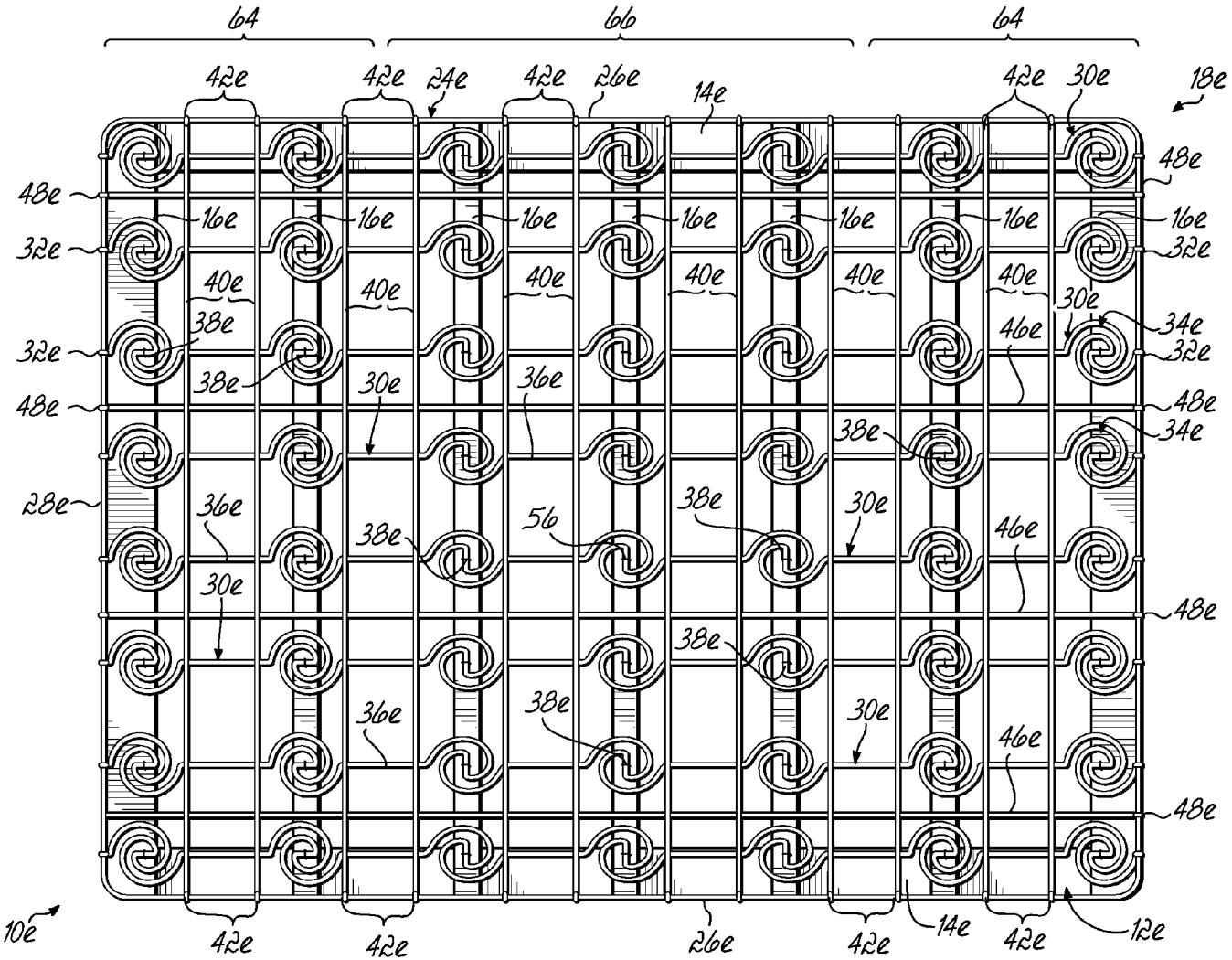
FIG. 17 is a top view of a portion of an alternative embodiment of bedding foundation.

An alternative embodiment of foundation 10*e* is shown in FIG. 17. The foundation 10*e* comprises a base 12*e* secured to a nestably stackable wire core assembly 18*e* with staples 56. For simplicity, like numbers have been used for like parts, but have an "e" designation after the number. The components of the nestably stackable wire core assembly 18*e* are identical to those of the wire core assembly 18 described above with the exception of the support wires. This foundation 10*e* is posturized or divided into three sections of differing firmness: two identical end or "soft" sections 64 and a middle or "firm" section 66 between the end or "soft" sections 64.

The support wires 30*e* of this embodiment, unlike the embodiments described above with reference to FIGS. 1-16 and shown therein, are different along their lengths. As shown in FIG. 17 each support wire 30*e* has flattened peaks 36*e* and pockets 34*e* between the flattened peaks 36*e*. As shown in FIG. 17, the pockets 34*e* of each support wire 30*e* differ in firmness and configuration.

In the embodiment illustrated in FIG. 17, each support wire 30*e* has two pockets 34*e* in each end or "soft" section 64 and three pockets 34*e* in the middle or "firm" section 66, the pockets of the end or "soft" sections 64 being different, i.e., firmer than the pockets in the middle or "firm" section 66. Each pocket 34*e* of each support wire 30*e* has a flattened valley 38*e* which, in the middle section 66, is parallel the ends 28*e*, 28*e* of the border wire 24*e* and which, in each end section 64 is parallel the sides 26*e*, 26*e* of the border wire 24*e*. Similarly, each support wire 30*e* has a series of spaced flattened peaks 36*e* which are parallel the sides 26*e*, 26*e* of the border wire 24*e*. As shown in FIG. 17, as one travels along the length of each support wire 30*e*, from one end to the other, the support wire 30*e* is formed into two pockets 34*e*, like the ones 34*b* shown in FIGS. 10-13, between the flattened peaks 36*e* and then formed into three pockets 34*a*, like the ones shown in FIGS. 6-9, between other flattened peaks 36*e* of support wire 30*e* and lastly is formed into two additional pockets 34*e*, like the ones 34*b* shown in FIGS. 10-13, between additional flattened peaks 36*e*. As seen in FIG. 17, each pocket 34*e* of the support wires 30*e* in the end or "soft" sections 64 is identical and each pocket 34*e* of the same support wires 30*e* in the middle or "firm" section 66 is identical.

In order to assemble foundation 10*e*, the base 12*e* is secured with staples 56 to one of the nestably stackable wire core assemblies 18*e*. More particularly, the flattened valleys 38*e* of the pockets 34*e* of the nestably stackable wire core assembly 18*e* are stapled to the slats 16*e* of the base 12*e*.

Figure 18:
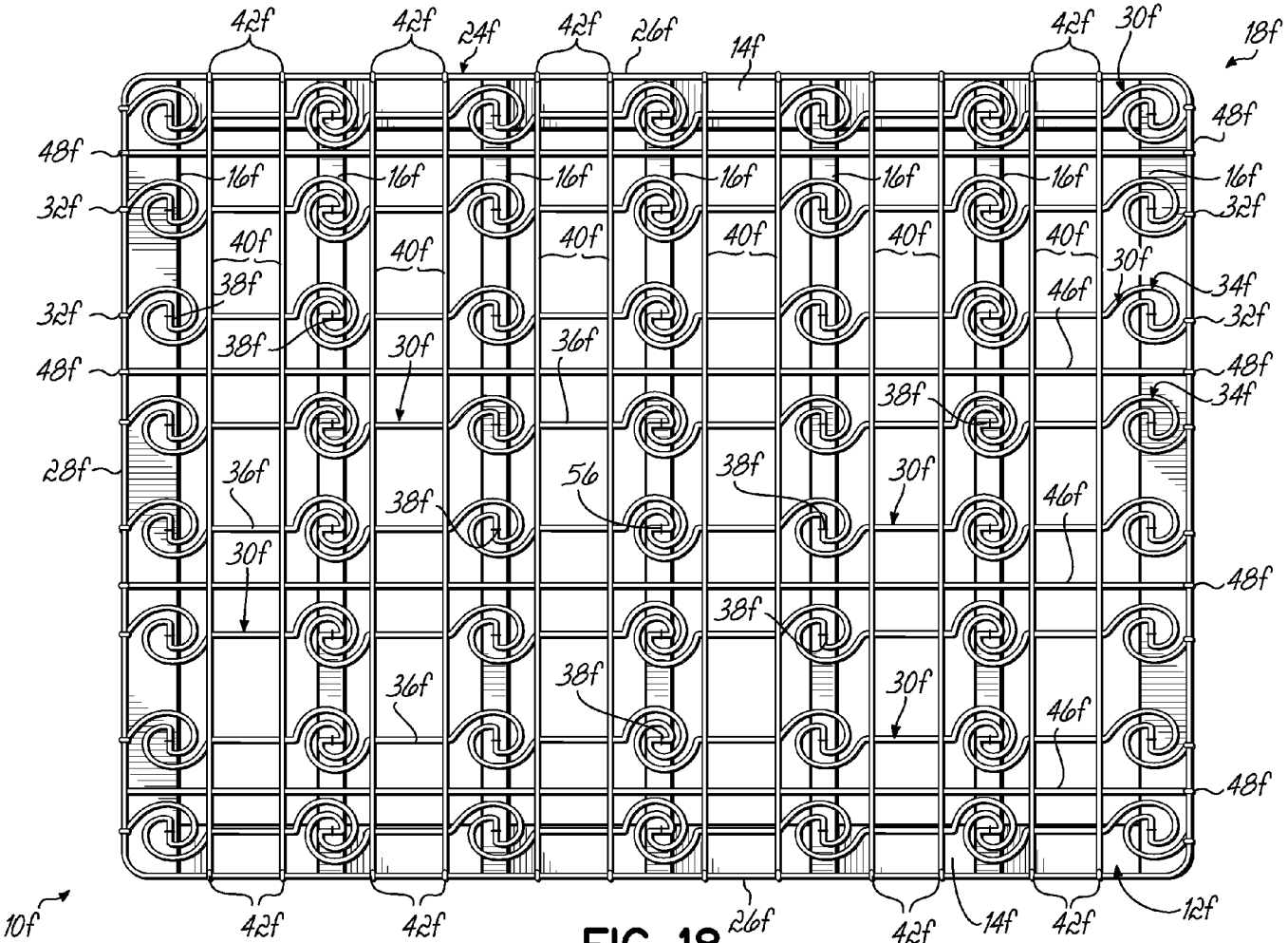
FIG. 18 is a top view of a portion of an alternative embodiment of bedding foundation.

An alternative embodiment of foundation 10*f* is shown in FIG. 18. The foundation 10*f* comprises a base 12*f* secured to a nestably stackable wire core assembly 18*f* with staples 56. For simplicity, like numbers have been used for like parts, but have an "f" designation after the number. The components of the nestably stackable wire core assembly 18*f* are identical to those of the wire core assembly 18 described above with the exception of the support wires. This foundation 10*f* has a checkerboard pattern of pockets 34*f* of two different firmnesses incorporated into its support wires 30*f*. Thus, the foundation 10*f* is not posturized, but rather has a relatively uniform firmness.

The support wires 30*f* of this foundation 10*f* are all identical and, like the support wires 10*e* described above with reference to FIG. 17 and shown therein, have pockets 34*f* of different firmness along their lengths. As shown in FIG. 18 each support wire 30*f* has flattened peaks 36*f* and pockets 34*f* between the flattened peaks 36*f*. As shown in FIG. 18, the pockets 34*f* of each support wire 30*f* differ in firmness and configuration.

In the embodiment illustrated in FIG. 18, each support wire 30*f* has every other pocket 34*f* being of a different configuration and firmness than adjoining pockets 34*f*. Thus, every other pocket 34*f* of support wire 30*f* is like the pockets 34*a* shown in FIGS. 6-9 and described herein and is different, i.e., firmer than the pockets 34*f* beside it which are configured like the pockets 34*b* shown in FIGS. 10-13 and described herein. Each pocket 34*f* of each support wire 30*f* has a flattened valley 38*f* which, in every other pocket 34*f*, is parallel the ends 28*f*, 28*f* of the border wire 24*f* and which, in every other pocket 34*f* is parallel the sides 26*f*, 26*f* of the border wire 24*f*. Similarly, each support wire 30*f* has a series of spaced flattened peaks 36*f* which are parallel the sides 26*f*, 26*f* of the border wire 24*f*. As shown in FIG. 18, as one travels along the length of each support wire 30*f*, from one end to the other, the support wire 30*f* is formed into two different pockets 34*f*, every other pocket 34*f* being like pocket 34*b* shown in FIGS. 10-13 and described herein, between the flattened peaks 36*e* and every other pocket 34*f* being like the pocket 34*a* shown in FIGS. 6-9 and described herein, between other flattened peaks 36*e* of support wire 30*e*.

In order to assemble foundation 10*f*, the base 12*f* is secured with staples 56 to one of the nestably stackable wire core assemblies 18*f*. More particularly, the flattened valleys 38*f* of the pockets 34*f* of the support wires 30*f* of the nestably stackable wire core assembly 18*f* are stapled to the slats 16*f* of the base 12*f*.

One advantage of the present invention is that it facilitates storage and shipment of nestably stackable wire core assemblies and after assembly of the foundation the resulting foundation has improved resiliency. This improved resiliency derives from the configuration of the support wires and, more specifically, from the helical configuration of the pockets of the support wires. The foundation may be manufactured to meet specific resiliency requirements, for example, the foundation may be manufactured for use with a specific mattress having a specified resiliency.

While we have described several embodiments of our invention, those persons skilled in the art will readily recognize modifications and changes which may be made without departing from the spirit or scope of the invention. For example, any of the foundations described or illustrated herein may incorporate edge support wires as described herein. Accordingly, we intend for our invention to be limited only by the following claims:

We claim:

1. A bedding foundation comprising:

a rectangular base;

a nestably stackable wire core assembly fixedly attached atop said base;

padding overlying said nestably stackable assembly; and a fabric covering encasing said padding and said nestably stackable assembly and said base;

said nestably stackable assembly comprising:

a rectangular border wire having two parallel sides and two parallel ends;

transversely spaced and longitudinally extending support wires having ends connected to said border wire ends, at least some of said support wires having flattened peaks and flattened valleys and a pair of curved arms connecting the flattened peaks and flattened valleys, each arm being shaped in a helical formation, said flattened peaks being generally co-planar with a plane defined by said border wire, said flattened valleys being vertically displaced beneath and intermediate of said flattened peaks; and longitudinally spaced, parallel and transversely extending upper connector wires parallel to said border wire ends and having ends connected to said border wire sides, said upper connector wires being connected intermediate of their ends along their lengths to said flattened peaks of said support wires.

2. A bedding foundation comprising:

a rectangular base; and a nestably stackable wire core assembly fixedly attached atop said base; said nestably stackable assembly comprising:

a rectangular border wire having two parallel sides and two parallel ends;

transversely spaced and longitudinally extending support wires having ends connected to said border wire ends, at least some of said support wires having flattened peaks and flattened valleys and a pair of curved arms connecting the flattened peaks and flattened valleys, each arm being shaped in a helical formation, said flattened peaks being generally co-planar with a plane defined by said border wire, said flattened valleys being vertically displaced beneath and intermediate of said flattened peaks; and longitudinally spaced, parallel and transversely extending upper connector wires parallel to said border wire ends and having ends connected to said border wire sides, said upper connector wires being connected intermediate of their ends along their lengths to said flattened peaks of said support wires.

3. The bedding foundation of claim 2 wherein each of said valleys of said support wires is stapled to one of said slats of said base.

4. The bedding foundation of claim 2 wherein said flattened valleys are parallel said sides of said border wire.

5. The bedding foundation of claim 2 wherein said flattened valleys are parallel said ends of said border wire.

6. The bedding foundation of claim 2 wherein said support wires are resilient.

7. The bedding foundation of claim 2 further comprising edge support wires, each of said edge support wires having ends connected to said border wire ends, each of said support wires being formed so as to be generally corrugated along its length, said edge support wire having flattened peaks generally co-planar with the plane defined by said border wire and flattened valleys, said flattened valleys being displaced beneath and intermediate of the flattened peaks.

8. The bedding foundation of claim 7 wherein each of said valleys of said support wires is stapled to one of said slats of said base.

9. A bedding foundation comprising:

a rectangular base; and a nestably stackable wire core assembly fixedly attached atop said base; said nestably stackable assembly comprising:

a rectangular border wire having two parallel sides and two parallel ends;

transversely spaced and longitudinally extending support wires having ends connected to said border wire ends, at least some of said support wires having flattened peaks and resilient portions connecting the flattened peaks, said flattened peaks being generally co-planar with a plane defined by said border wire, said resilient portions having flattened valleys and arcuate arms extending upwardly from said flattened valleys, each arm being shaped in a helical formation; and longitudinally spaced, parallel and transversely extending upper connector wires parallel to said border wire ends and having ends connected to said border wire sides, said upper connector wires being connected intermediate of their ends along their lengths to said flattened peaks of said support wires.

10. The bedding foundation of claim 9 wherein each of said valleys of said support wires is stapled to one of said slats of said base.

11. The bedding foundation of claim 9 wherein said flattened valleys are parallel said sides of said border wire.

12. The bedding foundation of claim 9 wherein said flattened valleys are parallel said ends of said border wire.

13. A nestably stackable assembly for use in a bedding foundation comprising:

a rectangular border wire having two parallel sides and two parallel ends;

transversely spaced and longitudinally extending support wires having ends connected to said border wire ends, each of said support wires being formed of one piece of wire and having flattened peaks and flattened valleys and a pair of curved arms connecting the flattened peaks and flattened valleys, each arm being shaped in a helical formation, said flattened peaks being generally co-planar with a plane defined by said border wire, said flattened valleys being vertically displaced beneath and intermediate of said flattened peaks;

longitudinally spaced, parallel and transversely extending upper connector wires parallel to said border wire ends and having ends connected to said border wire sides, said upper connector wires being connected intermediate of their ends along their lengths thereof to said peaks of said support wires.

14. The nestably stackable assembly of claim 13 wherein longitudinal voids between said peaks are of a dimension greater than said valleys.

15. The nestably stackable assembly of claim 13 being a first assembly, which, when placed atop a second assembly of like construction, is nestably stacked thereon when said valleys of said first assembly enter into said voids between said flattened peaks of said second assembly, said nested assemblies having a total height dimension less than a sum of a height dimension of said first assembly and a height dimension of said second assembly.

16. A nestably stackable assembly for use in a bedding foundation comprising:

a rectangular border wire having two parallel sides and two parallel ends;

transversely spaced, parallel and longitudinally extending support wires having ends connected to said border wire ends, each of said support wires being formed of one piece of wire and having flattened peaks and resilient portions connecting the flattened peaks, said flattened peaks being generally co-planar with a plane defined by said border wire, said resilient portions having flattened valleys and arcuate arms extending upwardly from said flattened valleys, each arm being shaped in a helical formation;

longitudinally spaced, parallel and transversely extending upper connector wires parallel to said border wire ends and having ends connected to said border wire sides, said upper connector wires being connected intermediate of their ends along their lengths to said flattened peaks of said support wires.

17. The nestably stackable assembly of claim 16 wherein longitudinal voids between said flattened peaks are of a dimension greater than said flattened valleys.

18. The nestably stackable assembly of claim 16 being a first assembly, which, when placed atop a second assembly of like construction, is nestably stacked thereon when said valleys of said first assembly enter into said voids between said flattened peaks of said second assembly, said nested assemblies having a total height dimension less than a sum of a height dimension of said first assembly and a height dimension of said second assembly.

* * * * *